US009045944B2

(12) United States Patent
Neidhardt et al.

(10) Patent No.: US 9,045,944 B2
(45) Date of Patent: Jun. 2, 2015

(54) PULL-DOWN METHOD AND EQUIPMENT FOR INSTALLING WELL CASING

(76) Inventors: Dietmar J. Neidhardt, The Woodland, TX (US); Kevin J. Nikiforuk, Cypress, TX (US)

( * ) Notice: Subject to any disclaimer, the term of this patent is extended or adjusted under 35 U.S.C. 154(b) by 286 days.

(21) Appl. No.: 13/697,869

(22) PCT Filed: May 13, 2011

(86) PCT No.: PCT/CA2011/000562

§ 371 (c)(1),
(2), (4) Date: Nov. 14, 2012

(87) PCT Pub. No.: WO2011/140648

PCT Pub. Date: Nov. 17, 2011

(65) Prior Publication Data

US 2013/0056275 A1 Mar. 7, 2013

Related U.S. Application Data

(60) Provisional application No. 61/334,624, filed on May 14, 2010.

(51) Int. Cl.

| | |
|---|---|
| ***E21B 19/08*** | (2006.01) |
| ***E21B 19/02*** | (2006.01) |
| ***E21B 3/02*** | (2006.01) |
| ***E21B 7/20*** | (2006.01) |
| ***E21B 19/084*** | (2006.01) |
| ***E21B 19/16*** | (2006.01) |

(52) U.S. Cl.
CPC ... *E21B 3/02* (2013.01); *E21B 7/20* (2013.01); *E21B 19/084* (2013.01); *E21B 19/16* (2013.01)

(58) Field of Classification Search
USPC ..... 166/77.2, 75.14
See application file for complete search history.

(56) References Cited

U.S. PATENT DOCUMENTS

| | | | | |
|---|---|---|---|---|
| 2,232,172 | A * | 2/1941 | Fortune | 254/29 R |
| 2,711,880 | A * | 6/1955 | McKenzie | 173/4 |
| 2,848,196 | A * | 8/1958 | Simmonds | 175/52 |
| 3,181,630 | A * | 5/1965 | Coburn | 175/85 |
| 3,190,378 | A * | 6/1965 | Davey, Sr. et al. | 175/257 |
| 3,239,016 | A * | 3/1966 | Alexander | 173/164 |

(Continued)

FOREIGN PATENT DOCUMENTS

| | | | |
|---|---|---|---|
| CA | 974973 | A1 | 9/1975 |
| CA | 2094313 | A1 | 10/1994 |
| CA | 2448841 | A1 | 5/2005 |

OTHER PUBLICATIONS

PCT Int'l Search Report and Written Opinion (PCT/CA2011/000562), dated Aug. 26, 2011.

*Primary Examiner* — Kenneth L Thompson

(57) ABSTRACT

A drilling rig having a top drive has a pipe gripper with a mandrel having an upper end for connection to and rotation with a drive string extending downward from the top drive. The pipe gripper has gripping elements that move radially into engagement with a string of pipe. A pull-down mechanism is mounted to the rig and secured to a non-rotating portion of the pipe gripper for exerting a downward force on the mandrel. A sensor is operatively coupled to the top drive to sense weight being supported by the top drive. A controller is linked to the sensor and the pull-down mechanism for controlling the downward force exerted on the mandrel by the pull-down mechanism in response to the weight sensed by the sensor.

19 Claims, 3 Drawing Sheets

(56) References Cited

U.S. PATENT DOCUMENTS

| | | | | |
|---|---|---|---|---|
| 3,340,938 | A * | 9/1967 | Wilson | 173/28 |
| 3,464,507 | A * | 9/1969 | Smith et al. | 175/85 |
| 3,659,655 | A * | 5/1972 | Gyongyosi | 173/1 |
| 3,719,238 | A * | 3/1973 | Campbell et al. | 173/147 |
| 4,100,968 | A | 7/1978 | Delano | |
| 4,103,745 | A | 8/1978 | Varich et al. | |
| 4,236,408 | A * | 12/1980 | Corry | 73/152.43 |
| 5,197,553 | A | 3/1993 | Leturno | |
| 5,890,844 | A * | 4/1999 | Schellhorn | 405/267 |
| 6,315,059 | B1 | 11/2001 | Geldean | |
| 6,672,410 | B2 | 1/2004 | Smith | |
| 6,679,333 | B2 | 1/2004 | York et al. | |
| 7,445,050 | B2 * | 11/2008 | Kuttel et al. | 166/380 |
| 8,336,614 | B2 * | 12/2012 | Bagassi | 166/77.1 |
| 2004/0206511 | A1 | 10/2004 | Tilton et al. | |

* cited by examiner

PULL-DOWN METHOD AND EQUIPMENT FOR INSTALLING WELL CASING

CROSS-REFERENCE TO RELATED APPLICATION

This application claims priority to provisional application Ser. No. 61/334,624, filed May 14, 2010.

FIELD OF THE DISCLOSURE

This invention relates in general to running casing into a well and drilling with casing, and in particular to using pull-down cables and winches to force the casing into extended reach wells.

BACKGROUND OF THE DISCLOSURE

Top drives for earth boring drilling rigs are employed to rotate the pipe string. The top drive has a rotary motor and is pulled up and down a derrick by a set of blocks. While running casing or drilling with casing, a pipe gripping mechanism may be secured to the drive stem or quill extending downward from the top drive. The pipe gripping mechanism has gripping elements that are moved radially into gripping engagement with either the inner or outer diameter of the casing string.

While running a casing string, the downward movement of the top drive depends on the apparent weight of the casing string and the pipe gripping mechanism supported by the top drive. If the weight being imposed on the top drive is adequate to pull casing string down the well, personnel on the drilling rig will control the rate of descent of top drive through a draw works brake.

In highly deviated wells, the apparent weight of the casing string being supported by the top drive will likely decrease as the casing string lengthens because of the friction of the casing string in the deviated well. The weight imposed on the top drive due to the weight of the casing string could theoretically become zero, stopping descent of the casing string. For operational reasons, one would always want the top drive and the upper section of the pipe gripping mechanism to be under tension. Otherwise, one might accidentally apply the full weight of the top drive onto the pipe gripping mechanism, causing extensive damage.

SUMMARY

A pipe gripper has a mandrel with an upper end for connection to and rotation with a drive string extending downward from the top drive. The pipe gripper has gripping elements that move radially into engagement with a string of pipe. A pull-down mechanism mounts to the rig and is secured to a non-rotating portion of the pipe gripper for selectively exerting a downward force on the mandrel.

Preferably, a sensor is operatively coupled to the top drive to sense weight being supported by the top drive. A controller linked to the sensor and the pull-down mechanism controls the downward force exerted on the mandrel by the pull-down mechanism in response to the weight sensed by the sensor. Particularly, the controller causes the pull-down mechanism to exert a downward force if the axial forces sensed between the top drive and the pipe gripper become compressive while the string of pipe is being lowered into the well. The controller may be configured to cause the pull-down mechanism to exert a downward force to maintain a substantially constant tensile force in the drive string.

The non rotating portion of the pipe gripper comprises a frame of the pipe gripper. A thrust bearing is mounted between the mandrel and the mandrel and the frame. The pull-down mechanism is connected to the frame, such that the downward force imposed by the pull-down mechanism transfers through the thrust bearing to the mandrel and through the gripping elements to the string of pipe.

The pull-down mechanism may have portions secured to opposite sides of a pipe elevator link bracket. The pull-down mechanism may comprise at least one winch. A cable wrapped around the winch is in operative engagement with the non-rotating portion of the pipe gripper. Two winches may be used, with cable from each extending to opposite sides of the elevator link bracket. The winches may be mounted below a rig floor. The cables may pass through holes in the rig floor.

Figure 1:
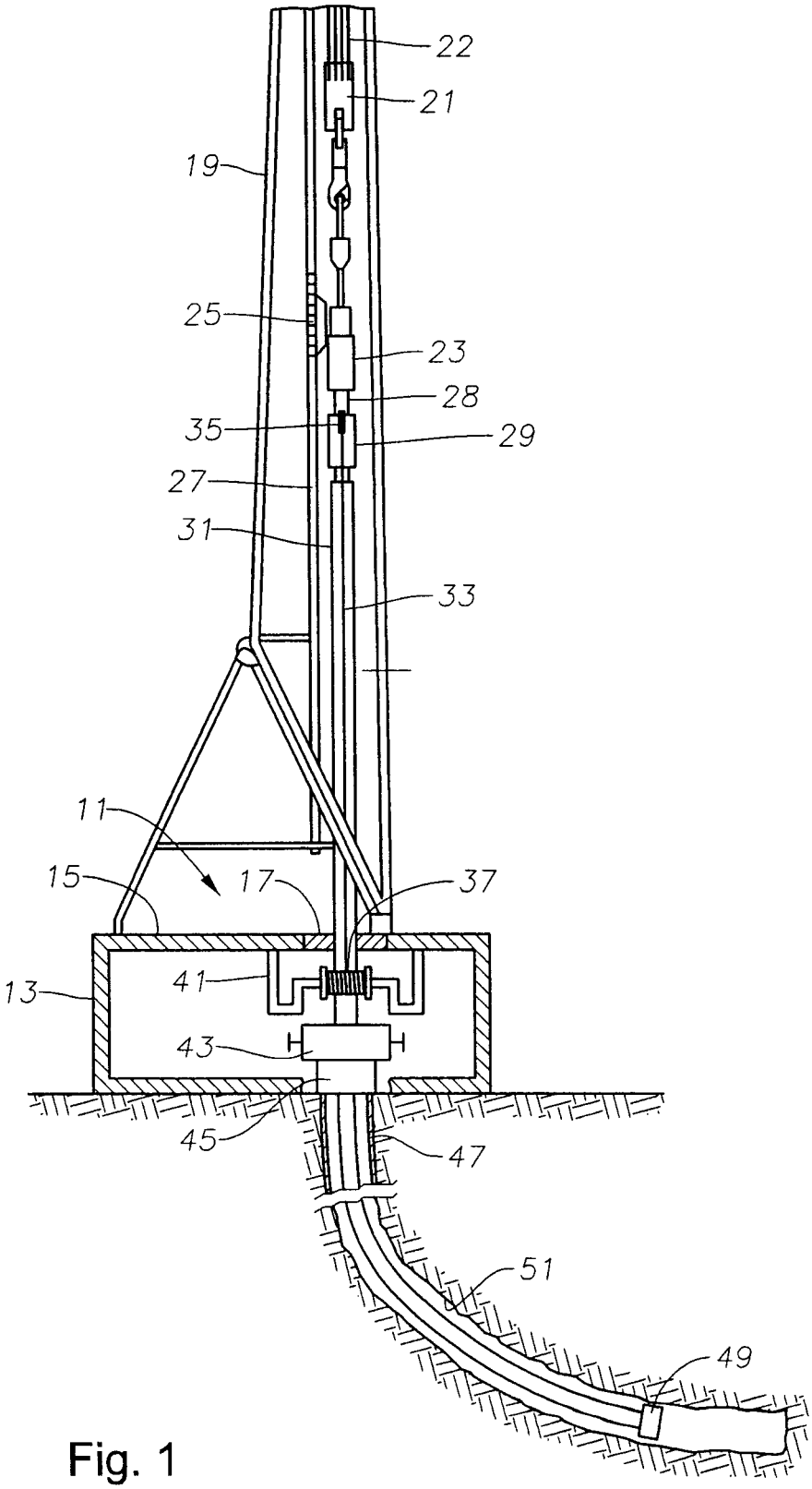
FIG. 1 is a side elevational view, partially schematic, illustrating a drilling rig having pull-down equipment for installing or drilling with casing.
Figure 2:
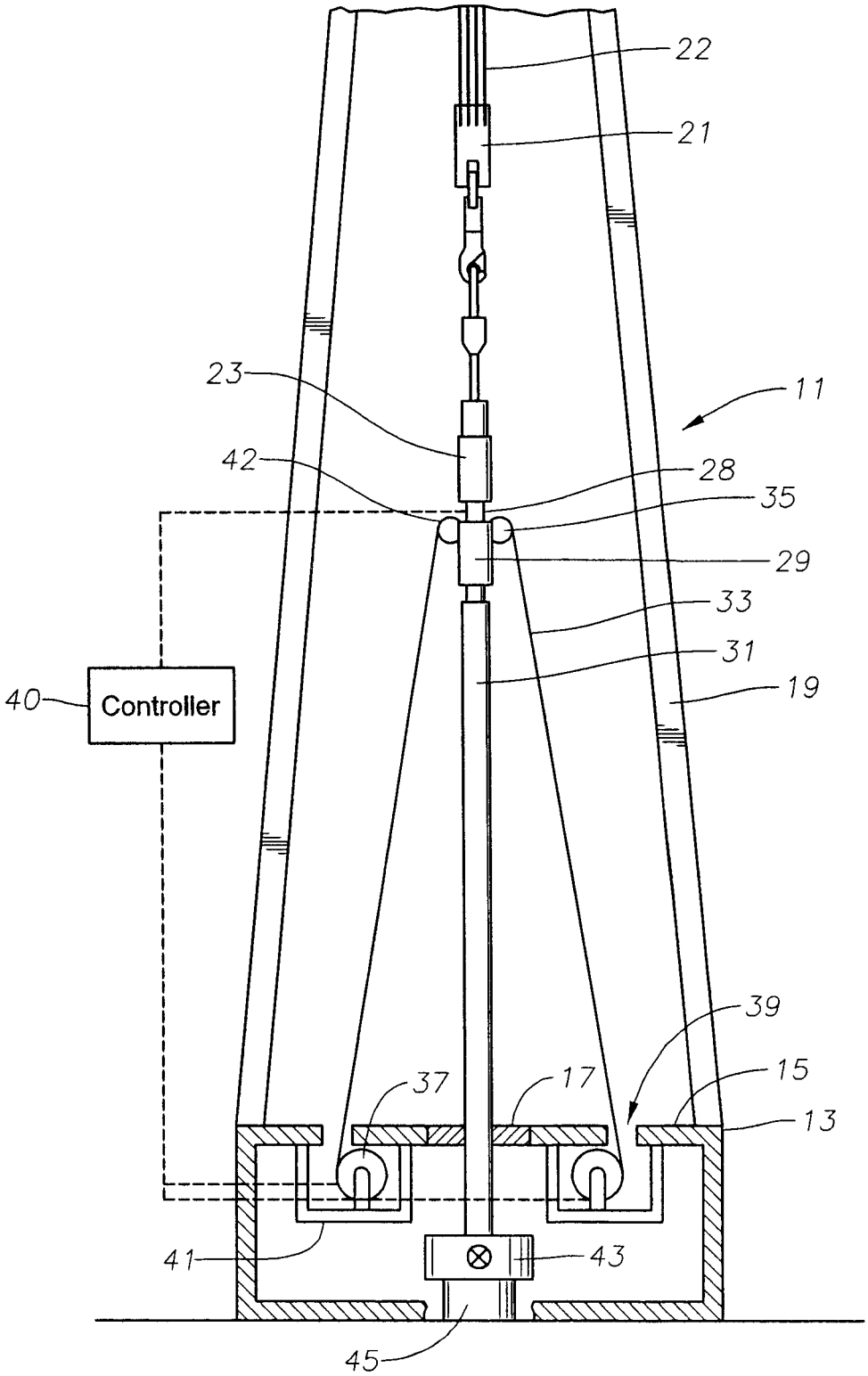
FIG. 2 is a front view of the drilling rig of FIG. 1.

DETAILED DESCRIPTION:

Referring to FIGS. 1 and 2, drilling rig 11 has a substructure 13 that will normally set on a land well site, or be part of an offshore drilling rig. Drilling rig 11 is employed in the construction of a well, including drilling and completing the well. Substructure 13 comprises beams that are arranged in an open truss-like configuration. A rig floor 15 locates on an upper side of substructure 13. A rotary table 17 is rotatably mounted in rig floor 15. A derrick 19 extends upward from substructure 13 and rig floor 15. Blocks 21 are suspended by a cable 22 that reeves over a crown block (not shown) to a draw works (not shown) for moving blocks 21 up and down derrick 19.

A top drive 23 is suspended from a hook of blocks 21 for vertical movement along derrick 19. Top drive 21 has an anti-rotation or torque restraint mechanism 25 that slides along one or more guide rails 27 mounted vertically in derrick 19. Top drive 23 comprises a motor, either electric or hydraulic, for rotating a drive stem or quill 28.

A pipe gripping mechanism 29 is secured either directly or indirectly to quill 28. Pipe gripping mechanism 29 has a gripping device for gripping a tubular member, such as casing string 31. Casing string 31 comprises sections of pipe secured to each other by threads and cemented in the well. The term "casing" is employed broadly to also include liner strings. A liner string is made up the same type of pipe as casing, but its upper end is located only a selected distance above the lower end of a previously installed casing string, rather than extending all the way to the wellhead.

Two or more pull-down cables 33 have upper ends mounted to a non rotating or actuator portion of pipe gripping mechanism 29. The actuator portion of pipe gripping mechanism 29 is held against rotation either by a brace extending downward from a non rotating portion of top drive 23 or by a separate anti-rotation device that engages and slides along guide track 27. As shown in FIG. 2, each pull-down cable 33 is secured to an arm or gusset 35 extending outward from pipe gripping mechanism 29. Cables 33 extend downward through floor openings 39 to winches 37. Each winch 37 is powered either hydraulically or electrically to wind up and let out one of the cables 33. Each winch 37 may be constructed similar to a heave compensator winch used with floating platforms offshore. Heave compensator winches hold a riser under tension during wave and vessel movements.

A controller 40 has an input from a sensor 42, which may comprise strain gauges mounted on a sub attached between quill 28 and pipe gripping mechanism 29. Sensor 42 may be located elsewhere for sensing the load supported by top drive 23 or pipe gripping mechanism 29. Sensor 42 may send RF signals to controller 40 or it may be wired directly to controller 40. Sensor 42 will sense the axial forces in the pipe string between pipe gripping mechanism 29 and top drive 23. Controller 40 is linked with and controls winches 37 to selectively cause them to stop rotation, or to rotate in a take-up direction or to play out cable 33. Controller 40 has means for an operator to select a force to be applied by cables 33 to the upper end of casing string 31 as cable string 31 descends. While running casing string 31, the downward movement of top drive 23 depends on the apparent weight of casing string 31 and pipe gripping mechanism 29 supported by top drive 23. If the weight being imposed on top drive 23 is adequate to pull casing string 23 down the well, personnel on drilling rig 11 will control the rate of descent of top drive 23 through a draw works brake. When the weight is adequate, controller 40 causes winches 37 to merely take-up slack as no pull down force is needed In highly deviated wells, the apparent weight of casing string 31 being supported by top drive 23 will likely decrease as casing string 31 lengthens because of the friction of casing string 31 in the deviated well. The weight imposed on top drive 23 due to the weight of casing string 31 could theoretically become zero, stopping descent of casing string 31. For operational reasons, one would always want top drive 23 and the upper section of pipe gripping mechanism 29 to be under tension. Otherwise, one might accidentally apply the full weight of top drive 23 onto pipe gripping mechanism 29, causing extensive damage. Controller 40 senses the decrease in weight imposed on top drive 23 from the sensor and has software to make up the loss in weight by causing winches 31 to provide a pull down force through cables 33 to casing string 31. If the tensile forces sensed by sensor 42 become compressive, controller 40 will actuate winches 37 to apply a downward force to bring the drive string between top drive and pipe gripping mechanism 29 back into tension. Controller 40 may control winches 37 so that the pull down force plus the apparent weight being sensed will remain substantially constant. Optionally, the operator may select rotation rates for winches 37 to cause and maintain a desired speed or rate of descent of casing string 31 as it is being installed. Controller 40 or winches 37 will have safety features to prevent them from exceeding the tensile strength of cables 33.

Additionally, sensor 42 could optionally also send signals to controller 40 indicating torque, rotational speed and the volume of drilling fluid being pumped through casing string 31. While running casing string 31, the operator may wish to pump drilling fluid through casing string 31 to assist in lubricating the wellbore and facilitate the downward movement of casing string 31. Too high of a flow rate could result in a tendency to pump casing string 31 upward. By monitoring the load supported by top drive 23, controller 40 can increase the tension in cables 31 to avoid such an occurrence.

Winches 37 could be mounted on rig floor 15, but are preferably mounted below rig floor 15. They may be mounted on cradles 41 that are supported by an upper portion of substructure 13. Alternately, cradles 41 could extend downward to the base or lower portion of substructure 13.

FIG. 1 also illustrates casing string 31 extending into and through a blowout preventer 43 that is mounted on top of a wellhead 45. One or more strings of casing 47 may have already been cemented in the well. In the example shown in FIG. 1, open borehole 51 is illustrated as being highly deviated to create an extended reach well. That is, borehole 51 extends laterally from drilling rig 11 a considerable distance and may include a generally horizontal portion. In the example shown in FIG. 1, borehole 51 has been previously drilled using drill pipe (not shown) and top drive 23, rather than using casing gripping mechanism 29 to drill with casing string 31. In FIG. 1, the operator has retrieved the drill pipe and is now running casing string 31 to be cemented into the well. A casing shoe 49 is located at the lower end of casing string 31. Casing shoe 49 normally has a float valve within it that will prevent the backflow of cement into the interior of casing string 31. The float valve allows cement to flow out and up around the annulus of casing string 31.

Alternatively, casing string 31 could be employed for drilling borehole 51 by the operator utilizing top drive 23 and pipe gripping mechanism 29 to rotate casing string 31. If used for drilling, a bottom hole assembly (not shown) would be located at and protruding from the lower end of casing string 31. The bottom hole assembly may have a drill bit, an underreamer and also include instruments and other steering devices for directing the deviation desired of borehole 51. The bottom hole assembly may be retrievable. Alternately, a disposable/drillable bit may be located at the lower end of casing string 31. A disposable/drillable bit would not be retrievable.

Figure 3:
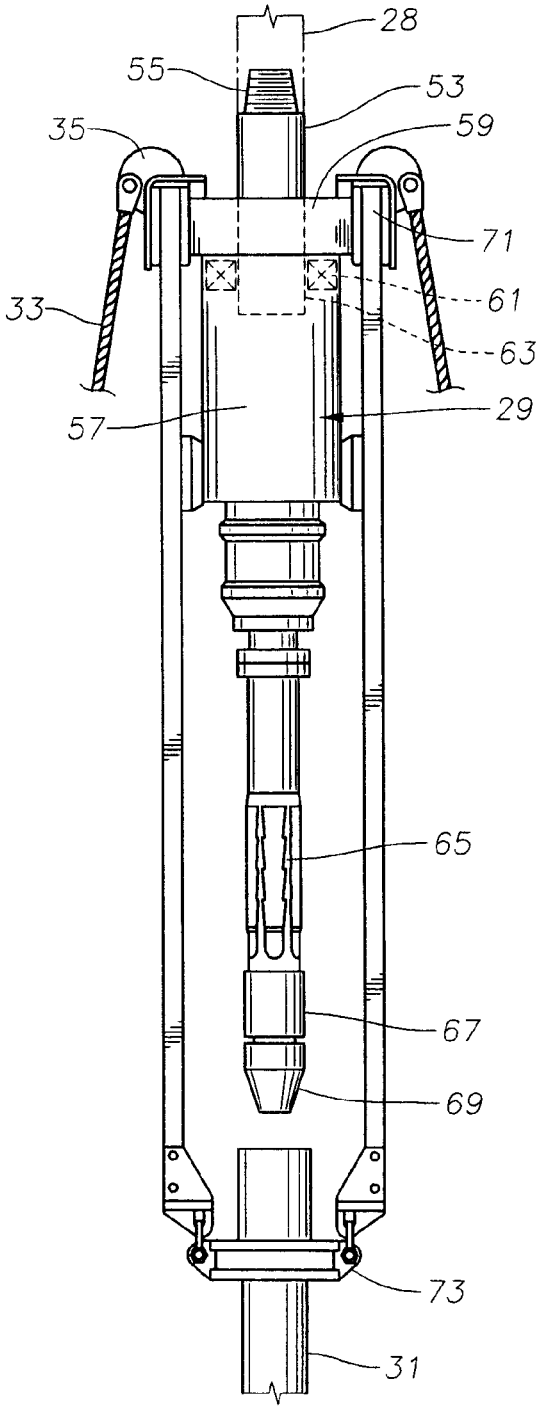
FIG. 3 is an enlarged front view of the casing gripping mechanism employed with the drilling rig of FIGS. 1 and 2, shown with an internal gripping device.

Referring to FIG. 3, pipe gripping mechanism 29 has a mandrel 53 that extends rotatably through it. Mandrel 53 has a threaded upper end 55 that will secure to the threads of drive quill 28 or intervening tubular members, such as a sub for sensor 42 (FIG. 1). In this example, pipe gripping mechanism 29 has an actuator portion enclosed by a housing 57 that is non-rotatable. Housing 57 includes a frame or bracket 59 at its upper end, which may be integrally formed with housing 57. A thrust bearing 61 may be located below and in engagement with a lower side of bracket 59. A thrust runner 63 may be attached to mandrel 53 for rotation therewith. Thrust runner 63 is located below and engages a lower side of thrust bearing 61 to transmit thrust while mandrel 65 is supporting the weight of and rotating pipe string 31. Downward force imposed on bracket 59 by pull-down cables 33 (FIG. 4) passes through thrust bearing 61 and runner 63 to mandrel 53. If thrust bearing 61 is inadequate to withstand the maximum downward forces imposed by winches 37, an additional thrust bearing may be attached to pipe gripping mechanism.

In FIG. 3, pipe gripping mechanism 29 is fitted with an internal pipe gripper for gripping an inner sidewall of casing string 31. The internal pipe gripper is mounted to mandrel 53 for rotation therewith and includes grapples 65 that are moved radially outward from mandrel 53 in response to axial movement of a fluid piston (not shown). The fluid piston is contained within the actuator portion of pipe gripping mechanism 29. Gripping elements such as grapples 65 will engage the inner sidewall of casing string 31 to transmit both rotation as well as support the weight of casing string 31. The downward force imposed on mandrel 53 by cables 33 may transmit directly through grapples 65 to casing string 31. A seal 67 is located below grapples 65 near the lower end of mandrel 53 for sealing against the inner diameter of casing string 31. Seal 67 allows the operator to pump fluid down casing string 31 as it will prevent the fluid from flowing out the upper end of casing string 31. The fluid is pumped through a nose 69 that forms the lower end of mandrel 53 and rotates with it. The fluid discharges from nose 69.

A pair of links 71 is pivotally mounted to axles extending from bracket 59 on opposite sides from each other. Each link 71 will pivot about its axle in a single plane. An elevator 73 attaches to the lower ends of links 71. Elevator 73 will open and close around a joint of casing 31 below a collar secured to an upper end of the joint of casing 31.

Each of the gussets 35 is mounted to an upper side bracket 59 above one of the links 71 in a position so as to not interfere with the pivotal movement of links 71. Each gusset 35 extends laterally outboard of one of the links 71. Cables 33 are mounted to gussets 35 by pins or devises. The upper ends of cables 33 are located 180 degrees apart from each other on bracket 59. Other arrangements to mount cables 33 to non rotating portions of pipe gripping mechanism are feasible.

Figure 4:
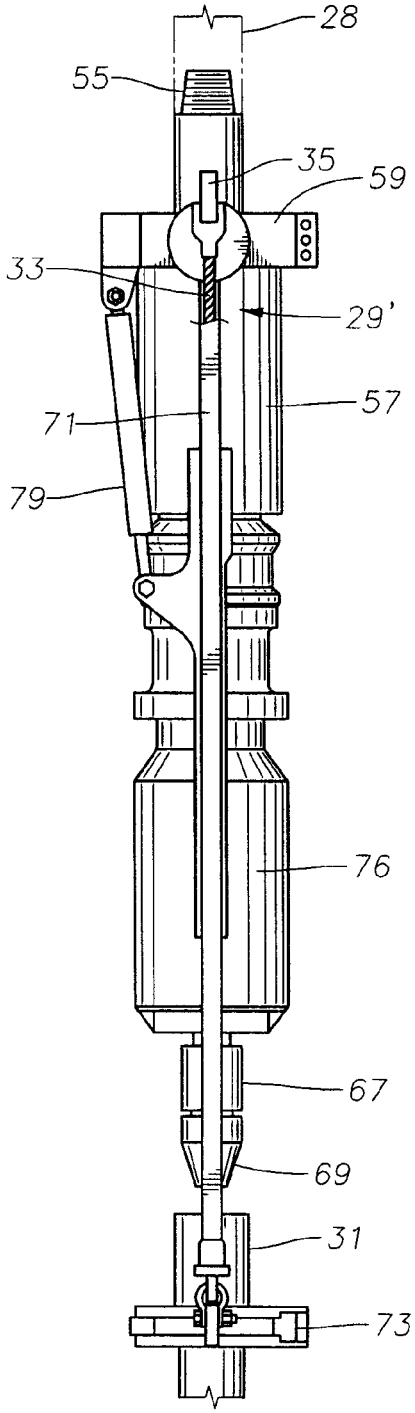
FIG. 4 is an enlarged front view of a casing gripping mechanism for use with the drilling rig of FIGS. 1 and 2, but shown from a different side than the casing gripping mechanism of FIG. 3 and shown with an external gripping device.

FIG. 4 illustrates an alternate embodiment of a casing gripping mechanism 29' as it is configured with an external gripper 76. External gripper 76 has dies (not shown) within it that when actuated, move radially inward to grip the outer diameter of casing string 31. The components of casing gripping mechanism 29' that are the same as in FIG. 3 have the same numerals. Pipe gripping mechanism 29' is shown at an angle 90 degrees from that of FIG. 3. In both embodiments, gussets 35 are 180 degrees apart from each other. FIG. 4 also illustrates a pivotal fluid cylinder 79 attached between bracket 59 and each link 71 for pivoting links 71.

In operation, the operator will connect pipe gripping mechanism 29 to quill 28 of top drive 23. The operator installs winches 37 underneath rig floor 15. Cables 33 will be attached to gussets 35 on pipe gripping mechanism 29. To run casing string 31 into a previously drilled borehole 51, the operator will support a first portion of casing string 31 with slips or a spider (not shown) mounted on rotary table 17. The operator will use elevator 73 (FIG. 3) and links 71 to pick up an add-on joint of casing for casing string 31. The operator then lowers the add-on casing joint by lowering top drive 23 until the add-on casing joint is supported on the upper end of casing string 31 supported at rotary table 17. During this procedure, winches 37 will simply maintain cable 31 snug but will not be exerting any pull-down force. The operator stabs grapples 65 (FIG. 3) into the upper end of the add-on casing joint. The operator actuates grapples 65 to grip the add-on casing joint and rotates mandrel 53 with top drive 23 to cause the add-on casing joint to secure to casing string 31. The operator lifts casing string 31, releases the slips, then begins lowering casing string 31 into the well.

The controller 40 will receive signals from sensor 42 indicating the weight suspended by top drive 23; if necessary, controller 40 will apply a selected force by rotating winches 37 to apply tension to cables 33. The force passes from cables 33 to bracket 59 and from bracket 59 to thrust bearing 61 to mandrel 53. The force is transferred via grapples 65 to casing string 31. This force will assure that quill 28 and the portion of mandrel 53 above thrust bearing 61 will always be in tension while casing string 31 is being lowered. Winches 37 will maintain a selected downward force until the upper end of the add-on joint of casing string 31 nears the rig floor. At that point, the operator actuates the slips at rotary table 17 and releases pipe gripping mechanism 29 from the casing string 31. The operator then pulls top drive 23 and pipe gripping mechanism 29 up derrick 19. As pipe gripping mechanism 29 moves up to receive a new joint of casing, controller 40 causes winches 37 to play out cables 33, applying only a residual tension. The operator then repeats the steps mentioned above.

Similar steps may be used for drilling as explained above. During drilling, the operator will be rotating casing string 31 to drill the borehole 51.

Hydraulic pistons or actuators alternatively may be employed rather than winches and cables. A telescoping piston could be mounted below the rig floor on opposite sides of the rotary table. The telescoping pistons could be hydraulically extended through holes in the rig floor up into engagement with opposite sides of the casing gripping mechanism for exerting pull-down forces on the casing gripping mechanism.

The invention claimed is:

1. An apparatus for performing well construction operations with a drilling rig having a top drive, comprising:

a pipe gripper having a mandrel with an upper end for connection to and rotation with a drive string extending downward from the top drive, the pipe gripper having gripping elements that move radially into engagement with a string of pipe;

a pull-down mechanism adapted to be mounted to the rig and secured to a non-rotating portion of the pipe gripper for selectively exerting a downward force on the mandrel, wherein the pull-down mechanism comprises a pair of winches, each adapted to be mounted to the rig below a rig floor; and a cable wrapped around each of the winches, each of the cables adapted to pass through a hole or respective holes in the rig floor into operative engagement with opposite sides of the non-rotating portion of the pipe gripper.

2. The apparatus according to claim 1, further comprising:

a sensor adapted to be operatively coupled to the top drive to sense weight being supported by the top drive; and a controller linked to the sensor and the pull-down mechanism for controlling the downward force exerted on the mandrel by the pull-down mechanism in response to the weight sensed by the sensor.

3. The apparatus according to claim 1, wherein the drive string is a quill of the top drive.

4. The apparatus according to claim 1, wherein the string of pipe comprises a drill bit attached to a lower end of the string of pipe.

5. The apparatus according to claim 1, wherein gripping elements comprise grapples.

6. The apparatus according to claim 1, wherein the top drive comprises an anti-rotation mechanism.

7. The apparatus according to claim 6, wherein the anti-rotation mechanism is slidably coupled with one or more guide rails.

8. An apparatus for performing well construction operations with a drilling rig having a top drive, comprising:

a pipe gripper having a mandrel with an upper end for connection to and rotation with a drive string extending downward from the top drive, the pipe gripper having gripping elements that move radially into engagement with a string of pipe;

a pull-down mechanism adapted to be mounted to the rig and secured to a non-rotating portion of the pipe gripper for selectively exerting a downward force on the mandrel;

a sensor adapted to be coupled into the drive string to sense axial forces in the drive string between the top drive and the pipe gripper; and a controller linked to the sensor and the pull-down mechanism for causing the pull-down mechanism to exert a downward force to the non-rotating portion of the pipe gripper if the axial forces sensed become compressive while the string of pipe is being lowered into the well.

9. The apparatus according to claim 8, wherein:

the pull-down mechanism comprises at least one winch; and a cable wrapped around the winch and in operative engagement with the non-rotating portion of the pipe gripper.

10. An apparatus for performing well construction operations with a drilling rig having a top drive, comprising:

a pipe gripper having a mandrel with an upper end for connection to and rotation with a drive string extending downward from the top drive, the pipe gripper having gripping elements that move radially into engagement with a string of pipe;

a pull-down mechanism adapted to be mounted to the rig and secured to a non-rotating portion of the pipe gripper for selectively exerting a downward force on the mandrel;

a sensor adapted to be coupled into the drive string to sense tensile forces in the drive string between the top drive and the pipe gripper; and a controller linked to the sensor and the pull-down mechanism for controlling the pull-down mechanism, the controller being configured to cause the pull-down mechanism to exert a downward force to maintain a substantially constant tensile force in the drive string.

11. The apparatus according to claim 10, wherein:

the pull-down mechanism comprises a pair of winches; and a cable wrapped around each of the winches, the cables being in operative engagement with opposite sides of the non-rotating portion of the pipe gripper.

12. An apparatus for performing well construction operations with a drilling rig having a top drive, comprising:

a pipe gripper having a mandrel with an upper end for connection to and rotation with a drive string extending downward from the top drive, the pipe gripper having gripping elements that move radially into engagement with a string of pipe;

a pull-down mechanism adapted to be mounted to the rig and secured to a non-rotating portion of the pipe gripper for selectively exerting a downward force on the mandrel, wherein the non-rotating portion of the pipe gripper comprises a frame of the pipe gripper; and wherein the pipe gripper further comprises:

a thrust bearing mounted between the mandrel and the frame; and the pull-down mechanism is connected to the frame, such that the downward force imposed by the pull-down mechanism transfers through the thrust bearing to the mandrel and through the gripping elements to the string of pipe.

13. An apparatus for performing well construction operations with a drilling rig having a top drive, comprising:

a pipe gripper having a mandrel with an upper end for connection to and rotation with a drive string extending downward from the top drive, the pipe gripper having gripping elements that move radially into engagement with a string of pipe;

a pull-down mechanism adapted to be mounted to the rig and secured to a non-rotating portion of the pipe gripper for selectively exerting a downward force on the mandrel, wherein:

the non rotating portion of the pipe gripper comprises a bracket;

the pull-down mechanism has portions secured to opposite sides of the bracket; and the apparatus further comprises:

a pair of links having upper ends pivotally secured to the opposite sides of the bracket; and an elevator supported by lower ends of the links.

14. A method for performing well construction operations with a drilling rig having a top drive, comprising:

securing a mandrel of a pipe gripper to a drive string extending downward from the top drive;

moving gripping elements of the pipe gripper radially into engagement with a string of pipe;

lowering the string of pipe into the well;

with a pull-down mechanism, exerting a downward force on the mandrel;

sensing axial forces in the drive string between the top drive and the pipe gripper; and causing the pull-down mechanism to exert a downward force to the non-rotating portion of the pipe gripper if the axial forces sensed become compressive while the string of pipe is being lowered into the well.

15. The method according to claim 14, further comprising:

sensing weight being supported by the top drive; and controlling the downward force exerted on the mandrel by the pull-down mechanism in response to the weight sensed.

16. The method according to claim 14, further comprising:

rotating a drill bit attached to a lower end of the string of pipe as the string of pipe is being lowered.

17. The method according to claim 14, wherein:

the pull-down mechanism is controlled so as to maintain a constant rate of descent of the string of pipe.

18. A method for performing well construction operations with a drilling rig having a top drive, comprising:

securing a mandrel of a pipe gripper to a drive string extending downward from the top drive;

moving gripping elements of the pipe gripper radially into engagement with a string of pipe;

lowering the string of pipe into the well;

with a pull-down mechanism, exerting a downward force on the mandrel;

sensing tensile forces in the drive string between the top drive and the pipe gripper; and causing the pull-down mechanism to exert a downward force to maintain a substantially constant tensile force in the drive string.

19. The apparatus according to claim 18, wherein causing the pull-down mechanism to exert the downward force comprises actuating a pair of winches.

* * * * *